United States Patent [19]

Uehara et al.

[11] 4,282,631

[45] Aug. 11, 1981

[54] TILTABLE ROLLER ASSEMBLY

[75] Inventors: Takeo Uehara, Uozu; Haruo Hori, Kurobe, both of Japan

[73] Assignee: Yoshida Kogyo K.K., Tokyo, Japan

[21] Appl. No.: 25,914

[22] Filed: Apr. 2, 1979

[30] Foreign Application Priority Data

Apr. 3, 1978 [JP] Japan ..... 53/43532[U]
Apr. 17, 1978 [JP] Japan ..... 53/50450[U]

[51] Int. Cl.[3] ..... E05D 13/02

[52] U.S. Cl. ..... 16/102; 16/105; 49/425

[58] Field of Search ..... 16/97, 99, 91, 100, 16/102, 105; 49/425, 420, 421

[56] References Cited

U.S. PATENT DOCUMENTS 3,298,136 1/1967 Saunders ..... 49/425
4,189,870 2/1980 Helmick ..... 16/105 X

FOREIGN PATENT DOCUMENTS 52-34548 3/1977 Japan ..... 16/102

*Primary Examiner*—Peter P. Nerbun
*Attorney, Agent, or Firm*—Hill, Van Santen, Steadman, Chiara & Simpson

[57] ABSTRACT

A tiltable roller assembly attachable to a door or window sash includes an attachment frame mountable on the door or window sash, a tilt frame loosely mounted in the attachment frame and tiltable in a first direction, a roller frame pivotally mounted on the tilt frame, and a roller rotatably supported on the roller frame. A pair of spaced blocks are mounted in said tilt frame, with the roller frame disposed between the spaced blocks, and there is an adjustment screw threadedly extending through a selected one of the blocks into abutting engagement with the roller frame. The roller frame is pivotably adjustable relatively to the second frame in a second direction transverse to the first direction, in response to turning of the adjustment screw. The attachment frame includes a pair of spaced sidewalls between which the tilt frame is disposed, there being spring means acting between one of the sidewalls and the spaced blocks and normally urging the tilt frame against the other sidewall.

14 Claims, 15 Drawing Figures

TILTABLE ROLLER ASSEMBLY

BACKGROUND OF THE INVENTION

1. Field of the Invention:

The present invention relates to a tiltable roller assembly for attachment to movable closure means such as a door or a window sash.

2. Prior Art:

Tiltable roller assemblies have a tiltable roller which allows a window sash equipped with the assembly to move sideways in a direction parallel to the axis of the roller, thereby facilitating the locking of the window sash. One known such assembly is disclosed in Japanese Laid-Open Utility Model Publication No. 52-34548, published Mar. 11, 1977, and comprises an outer frame attachable to the lower rail of a window sash and an inner frame pivotally mounted in the outer frame and supporting a roller rotatably thereon. The inner frame is vertically adjustable by a screw extending threadedly through the outer frame into abutting engagement with the inner frame. Spring means act between the outer frame and the inner frame to urge the inner frame against one sidewall of the outer frame. Since the adjustment screw abuts directly against the inner frame, the screw and inner frame become gradually worn away as the inner frame is repeatedly tilted back and forth, requiring frequent vertical readjustments of the roller. When the adjustment screw is tightened excessively, the tilting movement of the inner frame becomes sluggish or even impossible.

Another disadvantage with the prior tiltable roller assembly is that it must be available in two symmetrical constructions, one being the mirror image of the other, so as to make the adjustment screws easily accessible when they are located at both ends of the lower rail of a window sash.

SUMMARY OF THE INVENTION

A tiltable roller assembly according to the invention includes a roller frame pivotally mounted on a tilt frame tiltably mounted in an attachment frame mountable on a door or a window sash. The roller frame is pivotably adjustable with respect to the tilt frame by a screw extending threadedly through a block attached to the tilt frame into abutting engagement with the roller frame. The attachment frame has a pair of sidewalls between which the tilt frame is disposed. The block has a bore in which there is received spring means acting between one of the sidewalls of the attachment frame and the block and normally biasing the tilt frame against the other of the sidewalls. According to an embodiment, said one of the sidewalls has bearing means with which the tilt frame engages, whereby the tilt frame is tiltable on the bearing means against the force from the spring means.

It is an object of the present invention to provide a tiltable roller assembly having independent mechanisms for tilting and vertically adjusting the roller.

Another object of the present invention is to provide a tiltable roller assembly with reliable vertical adjustment of the roller over a long period of time.

Still another object of the present invention is to provide a tiltable roller assembly having a structure that facilitates reversed use of the assembly.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
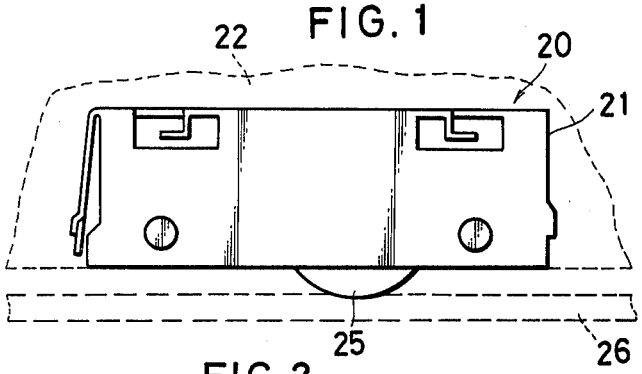
FIG. 1 is a front elevational view of a tiltable roller assembly constructed in accordance with the principles of the invention.
Figure 2:
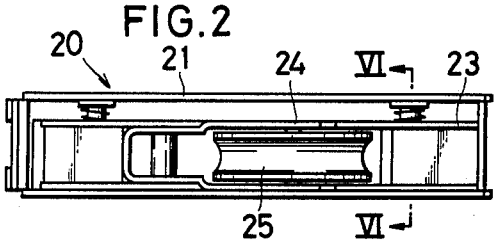
FIG. 2 is a bottom view of the assembly shown in FIG. 1.
Figure 3:
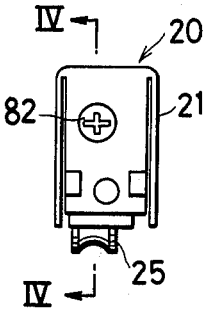
FIG. 3 is an end elevational view of the assembly of FIG. 1.

The principles of the present invention are particularly useful when embodied in a tiltable roller assembly such as shown in FIGS. 1 through 5, generally indicated by the numeral 20.

The tiltable roller assembly 20 basically comprises an attachment frame 21 adapted to be mounted on a horizontal lower member 22 (FIG. 1) of a door or window sash, a tilt frame 23 (FIGS. 2 and 4) loosely mounted in the attachment frame 21 and tiltable therein, a roller frame 24 pivotally mounted on the tilt frame 23 for positional adjustment relative to the tilt frame 23, and a roller 25 rotatably supported on the roller frame 24 and adapted to ride rollingly on a rail 26 mounted on a window frame (not shown).

Figure 5:
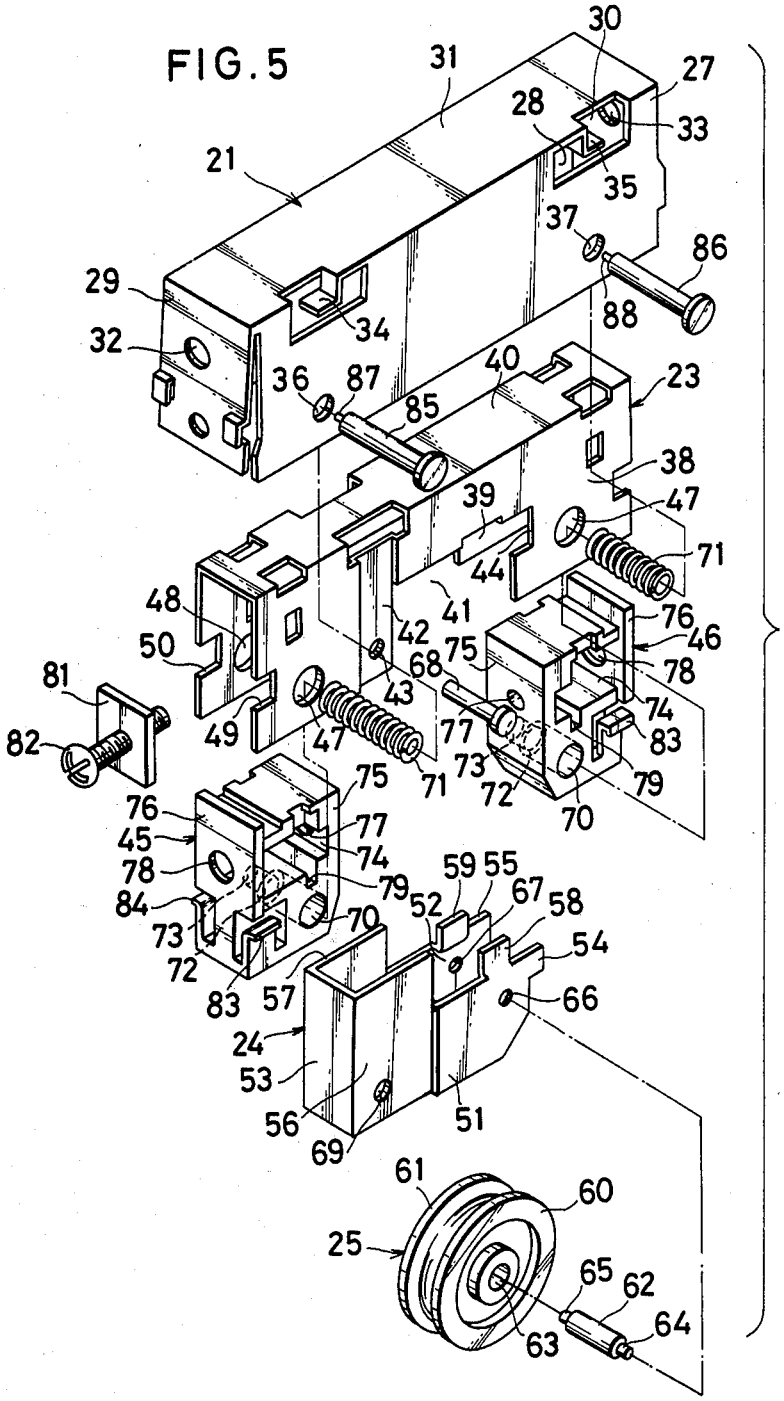
FIG. 5 is an enlarged exploded perspective view of the assembly of FIG. 1.
Figure 8:
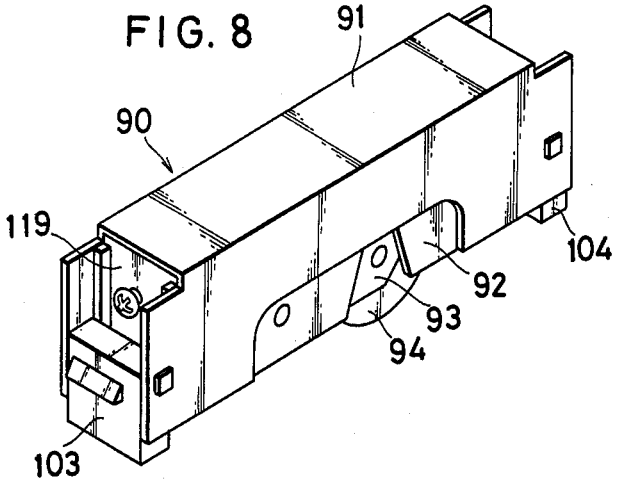
FIG. 8 is a perspective view of another embodiment of a tiltable roller.
Figure 9:
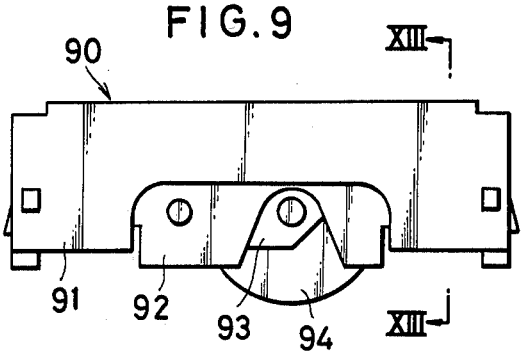
FIG. 9 is a front elevational view of the assembly shown in FIG. 8.
Figure 10:
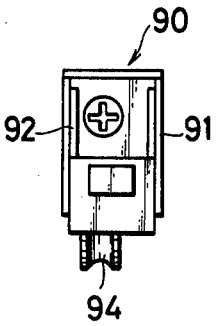
FIG. 10 is an end elevational view of the assembly of FIG. 8.
Figure 11:
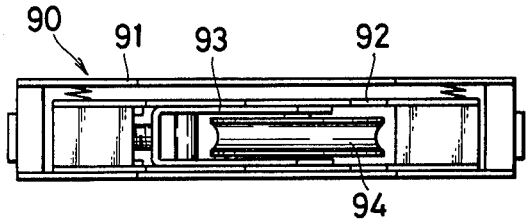
FIG. 11 is a bottom view of the assembly of FIG. 8.

As better illustrated in FIG. 5, the attachment frame 21 is of an elongate box-like structure including a pair of sidewalls 27,28, a pair of end walls 29,30, and a cover plate 31 extending along one edge of the sidewalls 27,28 and connecting the sidewalls 27,28 and end walls 29,30 together. The end walls 29,30 have a pair of longitudinally aligned holes 32,33, respectively. There are a pair of L-shaped projections 34,35 extending from the cover plate 31 downwardly into the interior of the attachment frame 21. The projections 34,35 are located adjacent to one of the sidewalls 27 and are spaced from each other longitudinally of the attachment frame 21. The sidewall 27 has a pair of holes 36,37 disposed remotely from the cover plate 31 in substantially vertical alignment with the projections 34,35, respectively.

The tilt frame 23 is substantially channel-shaped and comprises a pair of sidewalls 38,39 connected at one edge by a connector frame 40. The tilt frame 23 has a length slightly smaller than that of the attachment plate 21 and has a width substantially smaller than that of the attachment frame 21 such that when the tilt frame 23 is placed in the attachment frame 21, the tilt frame 23 is movable sideways in the transverse direction thereof. Each of the sidewalls 38,39 has a central opening 41 that opens away from the connector plate 40. Each sidewall 38,39 has a stepped portion 42 contiguous to one central opening 41, the stepped portion 42 having a hole 43. A recess 44 is disposed in each sidewall 38,39 and opens to the central opening 41, but located remotely from the stepped sidewall portion 42. The end portions of the tilt frame 23 serve to receive therein a pair of blocks 45,46, respectively, one on each side of the central opening 41. Each of the tilt frame end portions has a pair of holes 47,48 respectively in the sidewalls 38,39 and a pair of recesses 49,50 respectively in the sidewalls 38,39.

The roller frame 24 is of a substantially U-shaped cross section and is comprised of a pair of sidewalls 51,52 interconnected at one end by an end plate 53. The sidewalls 51,52 are spaced from each other by a distance which is equal to the distance at which the sidewalls 38,39 of the tilt frame 23 are spaced from each other. The sidewalls 51,52 of the roller frame 24 have a pair of horizontal projections 54,55, respectively, directed away from the end plate 53 and insertable with play respectively in the recesses 44,44 in the sidewalls 38,39 of the tilt frame 23. The sidewalls 51,52 of the roller frame 24 include a pair of inset portions 56,57, respectively, disposed contiguously to the end plate 53, the offset portions 56,57 being positionable between the stepped portions 42,42 of the respective tilt frame sidewalls 38,39. A pair of tabs 58,59 extend upwardly from the sidewalls 51,52, respectively, and are laterally inset therefrom toward each other.

The roller 25 has a pair of flanges 60,61 and is rotatably mounted on the roller frame 24 by a pin 62 extending through an axial hole 63 in the roller 25. The pin 62 has a pair of small-diameter end portions 64,65 retained respectively in a pair of apertures 66,67 in the sidewalls 51,52 of the roller frame 24. The roller 25 is disposed between the sidewalls 51,52 and is prevented from axial displacement or wobbling movement by the inset tabs 58,59. The roller frame 24 with the roller 25 supported thereon is pivotally mounted on the tilt frame 23 by a pin 68 extending through the holes 43,43 in the tilt frame sidewalls 38,39 and through a pair of holes 69,69 in the inset sidewall portions 56,57 of the roller frame 24. When the roller frame 24 is installed on the tilt frame 23, the projections 54,55 of the roller frame 24 are disposed loosely in the recesses 44,44. Accordingly, the roller frame 24 is pivotable up and down about the pin 68 to the extent that is determined by the clearance provided by the recesses 44,44.

Each of the blocks 45,46 has a bore 70 for receiving therein a compression coil spring 71, there being a shoulder 72 at the bottom of the bore 70 for supporting thereon the spring 71. A small-diameter bore 73 communicates coaxially with the bore 70. Each block 45,46 includes a through cavity 74 that is partly bounded by a front wall 75 and a rear wall 76. The front and rear walls 75,76 have axially aligned holes 77,78, respectively. A pair of vertically opposed slots 79,80 (better shown in FIG. 4) extend in each of the blocks 45,46 across the axial direction of the holes 77,78 and open to the cavity 74.

A substantially square plate 81 with an adjustment screw 82 extending threadedly therethrough is inserted in the cavity 74 in the block 45 in the slots 79,80. The screw 82 is turned to allow its distal end to enter the hole 77 in the front wall 75 of the block 45. The screw 82 can be turned by a screwdriver (not shown), the tip of which is insertable through the hole 78 in the rear wall 76. The hole 78 is smaller in diameter than the head of the screw 82 to prevent the screw 82 from dropping off through the hole 78. Each block 45,46 also includes a pair of side wings 83,84 positioned below the rear wall 76 and directed laterally away from each other. When each of the blocks 45,46 is mounted in position on the tilt frame 23, the side wings 84,84 ride on the lower edges of the recesses 49,50, respectively, in the tilt frame sidewalls 38,39.

The tiltable roller assembly 20 is assembled as follows: The roller 25 is supported on the roller frame 24, which is then mounted on the tilt frame 23. The square plate 81 with the adjustment screw 82 is put into the cavity 74 of the block 45, and the blocks 45,46 are inserted between the sidewalls 38,39 of the tilt frame 23 until the side wings 83,84 of the blocks 45,46 are disposed in the recesses 49,45, respectively, and the bores 70,70 are in registry with the holes 47,47, respectively, in the sidewall 38 of the tilt frame 23. The springs 71,71 are inserted into the bores 70,70, and then the tilt frame 23 is placed into the attachment frame 21 until the holes 47,47 in the tilt frame sidewall 38 become aligned with the holes 36,37 in the attachment frame sidewall 27. At this time, the tilt frame 23 is laterally displaced against the sidewall 38 by the springs 71,71 and the projections 34,35 on the cover plate 31 of the attachment frame 21. The tilt frame 23 is retained within the attachment frame 21 by a pair of pins 85,86 extending respectively through the holes 36,37 in the attachment frame sidewall 27, the springs 71,71, and the small-diameter bores 73,73. The pins 85,86 have a pair of small-diameter end portions 87,88 attached to the sidewall 28 of the attachment frame 21.

Figure 4:
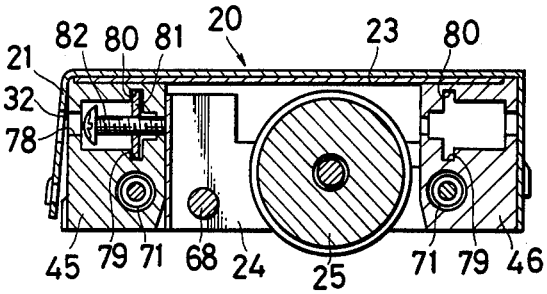
FIG. 4 is a cross-sectional view taken along line IV—IV of FIG. 3.

As best shown in FIG. 4, the vertical position of the roller 25 with respect to the tilt frame 23 and hence the attachment frame 21 can be adjusted by turning the adjustment screw 82 with a screwdriver inserted through the holes 32 and 78. When the screw 82 is turned clockwise, its distal end causes the roller frame 24 to pivot downwardly, whereupon the roller 25 is located in a lower position. When the screw 82 is turned counterclockwise, the roller 25 is allowed to be withdrawn upwardly by engagement with the rail 26 into the tilt frame 23 and hence the attachment frame 21.

Figure 6:
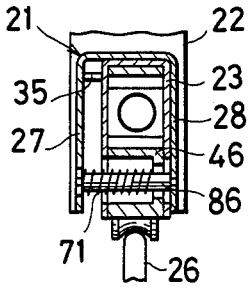
FIG. 6 is a cross-sectional view taken along line VI—VI of FIG. 2.
Figure 7:
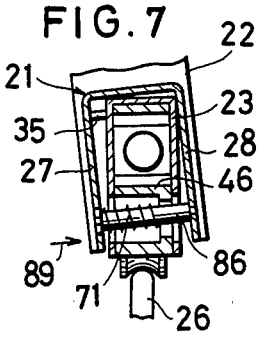
FIG. 7 is a view similar to FIG. 6, showing a tilted tilt frame.

In FIG. 6, the tilt frame 23 is pressed against the sidewall 28 of the attachment frame 21 under the force from the springs 71,71 acting between the attachment frame sidewall 27 and the blocks 45,46 in the tilt frame 23. In this position, the window sash 22 is horizontally slidable with the roller 25 rollingly engaging the rail 26. When the window sash 22 is pushed sideways in the direction of the arrow 89 in FIG. 7, the tilt frame 23 is caused to tilt laterally with respect to the attachment frame 21 against the bias of the springs 71,71 with the roller 25 riding on the rail 26. More specifically, the tilt frame 23 is borne by and pivots on fulcrum-like bearing means formed as the projections 34,35 in a direction to permit the tilt frame sidewall 38 to move closer to the attachment frame sidewall 27. Upon release of the lateral push on the window sash 22, the energy stored in the springs 71,71 enables the tilt frame 23 to be displaced toward the attachment frame sidewall 28, whereupon the attachment frame 21 and the tilt frame 23 are brought back to the position of FIG. 5.

When it is required to switch the position of the adjustment screw 82 around so as to use the roller assembly 20 reversely, the tilt frame 23 together with the blocks 45,46 and the springs 71,71 is removed from the attachment frame 21, and then the blocks 45,46 and the springs 71,71 are detached from the tilt frame 23. The attachment frame 21 is turned end for end, and is equipped with the block 45 from which the adjustment screw 82 and square plate 81 have been removed and with the block 46 into which the adjustment screw 82 and square plate 81 have been installed. Then, the tilt frame 23 is mounted in the attachment frame 21 with the springs 71 acting therebetween.

According to another embodiment shown in FIGS. 8 through 12, a tiltable roller assembly 90 generally comprises an attachment frame 91, a tilt frame 92 tiltably mounted in the attachment frame 91, a roller frame 93 vertically adjustably supported on the tilt frame 92, and a roller 94 rotatably supported on the roller frame 93.

Figure 12:
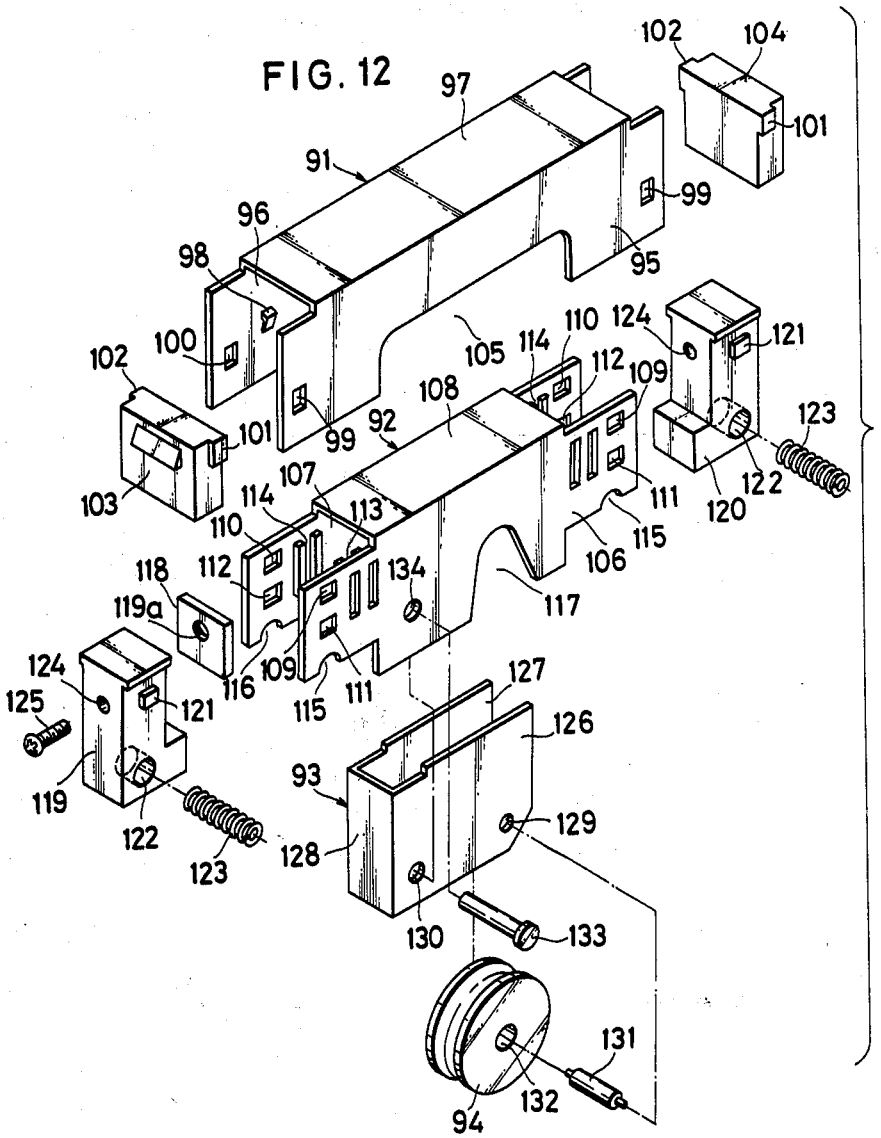
FIG. 12 is an exploded perspective view of the assembly of FIG. 8.

As best illustrated in FIG. 12, the attachment frame 91 has a pair of sidewalls 95,96 and an upper plate 97 connecting the sidewalls 95,96 together at their one edge. One of the sidewalls 96 has a pair of bearing means formed as ledges 98 (only one shown in the drawings) projecting toward the sidewall 95 and located adjacent to its ends. The attachment frame 91 has at each of its ends a pair of apertures 99,100 that are receptive of a pair of lateral projections 101,102 on each of a pair of attachment blocks 103, 104 that act as adapters to mount the tiltable roller assembly 90 on a lower member of a window sash (not shown). Each of the sidewalls 95,96 also has an opening 105, respectively, disposed centrally between both ends of the sidewalls 95,96 and located remotely from the upper plate 97.

The tilt frame 92 similarly includes a pair of sidewalls 106,107 interconnected by an upper plate 108. The attachment frame 91 has a pair of block holding portions at each of its ends, each block holding portion including a pair of upper transversely aligned apertures 109,110 and a pair of lower transversely aligned apertures 111,112 in the sidewalls 106,107. Each block holding portion also includes a pair of vertical channels 113,114 disposed respectively on the sidewalls 106,107 and facing each other. Further, each block holding portion has a pair of downwardly opening recesses 115,116 disposed respectively in the sidewalls 106,107. Each of the sidewalls 106,107 has a central opening 117 which opens away from the upper plate 108.

A substantially square plate 118 is disposed in a selected pair of the vertical channels 113,114, the square plate 118 having a threaded central hole 119*a*. Disposed respectively in the block holding portions are a pair of L-shaped blocks 119,120 each including a pair of ears 121 projecting laterally away from each other and a lateral blind hole 122 receiving a compression coil spring 123. Each block 119,120 also has a through hole 124 extending transversely of the blind hole 122. Each block 119,120 is supported between the sidewalls 106,107 of the tilt frame 92 with the ears 121,121 fitting in the upper apertures 109,110, respectively. An adjustment screw 125 extends through the hole 124 in the block 119 threadedly into the threaded hole 119*a* in the plate 118.

The roller frame 92 includes a pair of sidewalls 126,127 connected together by a vertical end plate 128, the sidewalls 126,127 having a pair of transversely aligned holes 129, respectively, and another pair of transversely aligned holes 130, respectively. The roller 94 is rotatably supported on the roller frame 93 by a pin 131 extending through a central axial hole 132 in the roller 94 and through the holes 129,129 in the roller frame sidewalls 126,127. The roller frame 93 with the roller 94 mounted thereon is pivotally supported on the tilt frame 92 by a pin 133 extending through the holes 130,130 in the roller frame 93 and through a pair of holes 134, respectively, in the tilt frame sidewalls 106,107, the holes 134 being located at one side of the central openings 117 so that the roller pin 131 is positioned in the central openings 117.

The tiltable roller assembly 90 is assembled by first mounting the roller frame 93 with the roller 94 rotatably supported thereon on the tilt frame 92, then attaching the blocks 119,120 to the tilt frame 92, putting the square plate 118 in the channels 113,114 which are closer to the hole 134 in the tilt frame sidewalls 106,107, with the screw 125 extending threadedly through the square plate 118 via the hole 124 in the block 119, placing the tilt frame 92 into the attachment frame 91 with the springs 123,123 disposed in the blind holes 122,122 and acting on the sidewall 95 of the attachment frame 91, and finally attaching the attachment blocks 103,104 to the attachment frame 91. The tilt frame 92 is pressed against the sidewall 96 of the attachment frame 91 under the bias of the springs 123,123. The ledges 98 on the sidewall 96 of the attachment frame 91 project into the lower apertures 112,112 in the sidewall 107 of the tilt frame 92 so as to retain the tilt frame 92 within the attachment frame 91.

Figure 13:
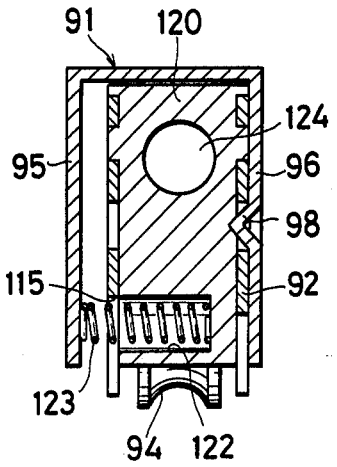
FIG. 13 is a cross-sectional view taken along line XIII—XIII of FIG. 9.
Figure 14:
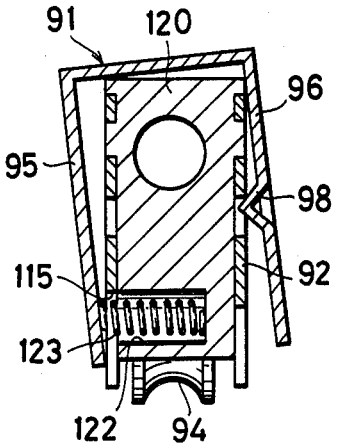
FIG. 14 is a view similar to FIG. 13, illustrating a tilted tilt frame.

The tilt frame 92 is normally pressed by the springs 123,123 against the sidewall 96 of the attachment frame 91, as illustrated in FIG. 13. However, when the window sash to which the tiltable roller assembly 90 is attached is pushed sideways, the tilt frame 92 is laterally moved with respect to the attachment frame 91 (FIG. 14) by engagement with the rail on which the roller 94 rides, thereby allowing the window sash to shift sideways.

Figure 15:
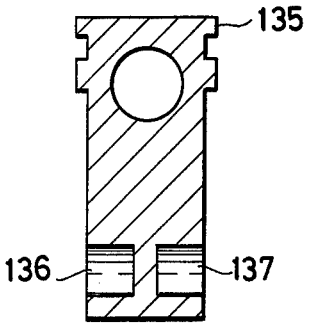
FIG. 15 is a cross-sectional view of a modified block usable in the assembly illustrated in FIGS. 8 through 14.

FIG. 15 illustrates a modified block 135 having a pair of blind holes 136,137 receptive of springs (not shown), respectively, and opening away from each other. An advantage of the modified block 135 is that is does not have to be detached from the tilt frame 92 when the latter is to be turned around to make the screw 125 accessible from the opposite side, and only the spring 123 is required to be transferred from the hole 136 to the hole 137 or vice versa.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A tiltable roller assembly for attachment to movable closure means, comprising:

(a) a first frame mountable on the movable closure means;

(b) a second frame loosely mounted in said first frame and tiltable therein in a first direction;

(c) a third frame pivotally mounted on said second frame;

(d) means on said second frame for positionally adjusting the position of said third frame relatively to said second frame in a second direction transverse to said first direction; and (e) a roller rotatably supported on said third frame.

2. A tiltable roller assembly according to claim 1, said first frame including a pair of spaced sidewalls between which said second frame is disposed, one of said sidewalls having bearing means with which said second frame engages, there being spring means acting between said one of said sidewalls and said second frame and normally urging said second frame against the other of said sidewalls, whereby said second frame is tiltable on said bearing means against the force from said spring means.

3. A tiltable roller assembly according to claim 2, said first frame further including a plate extending between said spaced sidewalls along their edges, said bearing means being located adjacent to said plate and said spring means being located remotely from said plate.

4. A tiltable roller assembly according to claim 1, said adjusting means comprising a block mounted in said second frame and an adjustment screw threadedly extending through said block into abutting contact with said third frame.

5. A tiltable roller assembly according to claim 4, said first frame including a pair of spaced sidewalls between which said second frame is disposed, said block having a bore, there being spring means disposed in said bore and acting between one of said sidewalls and said block, said spring means normally urging said second frame against the other of said sidewalls.

6. A tiltable roller assembly according to claim 5, including a pin extending through said bore between said spaced sidewalls of said first frame, said spring means comprising a compression coil spring disposed around said pin.

7. A tiltable roller assembly according to claim 4, said first frame including a pair of spaced sidewalls between which said second frame is disposed, said block having a pair of blind holes opening away from each other, there being spring means disposed in a selected one of said blind holes and acting between one of said sidewalls and said block, said spring means normally urging said second frame against the other of said sidewalls.

8. A tiltable roller assembly for attachment to movable closure means, comprising:

(a) a first frame mountable on the movable closure means;

(b) a second frame loosely mounted in said first frame and tiltable in first direction;

(c) a third frame pivotally mounted on said second frame;

(d) a pair of spaced blocks mounted in said second frame, with said third frame disposed between said spaced blocks, there being an adjustment screw threadedly extending through a selected one of said blocks into abutting engagement with said third frame, the position of said third frame being pivotably adjustable relatively to said second frame in a second direction transverse to said first direction, in response to turning of said adjustment screw; and (e) a roller rotatably supported on said third frame.

9. A tiltable roller assembly according to claim 8, said first frame including a pair of spaced sidewalls between which said second frame is disposed, there being spring means acting between one of said sidewalls and said spaced blocks and normally urging said second frame against the other of said sidewalls.

10. A tiltable roller assembly according to claim 9, said one of said sidewalls having bearing means with which said second frame engages, whereby said second frame is tiltable on said bearing means against the force from said spring means.

11. A tiltable roller assembly according to claim 10, said first frame further including a plate extending between said spaced sidewalls along their edges, said bearing means being located adjacent to said plate and said spring means being located remotely from said plate.

12. A tiltable roller assembly according to claim 9, said blocks having a pair of blind holes, respectively, opening away from each other, said spring means comprising a pair of compression coil springs each disposed in one of said holes and acting on said other of said sidewalls.

13. A tiltable roller assembly according to claim 9, said blocks having a pair of bores partially receptive of said spring means, and including a pair of pins extending through said bores, respectively, between said spaced sidewalls of said first frame, said spring means comprising compression coil springs disposed around said pins, respectively.

14. A tiltable roller assembly according to claim 8, said first frame including a pair of spaced sidewalls between which said second frame is disposed, each of said blocks having a pair of blind holes opening away from each other, and spring means disposed in a selected one of said blind holes and acting on one of said sidewalls, said spring means normally urging said second frame against the other of said sidewalls.

* * * * *